US010743612B2

(12) United States Patent
Iuchi et al.

(10) Patent No.: US 10,743,612 B2
(45) Date of Patent: Aug. 18, 2020

(54) MIDSOLE STRUCTURE FOR A SHOE

(71) Applicant: Mizuno Corporation, Osaka (JP)

(72) Inventors: Kazunori Iuchi, Suita (JP); Tatsuya Dazai, Nishinomiya (JP); Yoshitaka Takahashi, Osaka (JP); Takeshi Takeshita, Suita (JP)

(73) Assignee: Mizuno Corporation, Osaka-shi (JP)

( * ) Notice: Subject to any disclaimer, the term of this patent is extended or adjusted under 35 U.S.C. 154(b) by 181 days.

(21) Appl. No.: 15/550,115

(22) PCT Filed: Jan. 29, 2016

(86) PCT No.: PCT/JP2016/052647
§ 371 (c)(1),
(2) Date: Aug. 10, 2017

(87) PCT Pub. No.: WO2016/136381
PCT Pub. Date: Sep. 1, 2016

(65) Prior Publication Data

US 2018/0027923 A1 Feb. 1, 2018

(30) Foreign Application Priority Data

Feb. 27, 2015 (JP) ..... 2015-037901

(51) Int. Cl.
*A43B 13/18* (2006.01)
*A43B 7/14* (2006.01)
(Continued)

(52) U.S. Cl.
CPC ..... *A43B 13/186* (2013.01); *A43B 7/143* (2013.01); *A43B 7/144* (2013.01); *A43B 13/04* (2013.01);
(Continued)

(58) Field of Classification Search
CPC ..... A43B 13/186; A43B 13/04; A43B 13/122; A43B 13/127; A43B 13/188;
(Continued)

(56) References Cited

U.S. PATENT DOCUMENTS 4,798,010 A * 1/1989 Sugiyama ..... A43B 13/12 36/28
6,745,499 B2 * 6/2004 Christensen ..... A43B 13/20 36/29
(Continued)

FOREIGN PATENT DOCUMENTS

JP 2007-135827 A 6/2007
JP 2009-034438 A 2/2009
(Continued)

OTHER PUBLICATIONS

PCT International Search Report of the International Searching Authority for International Application PCT/JP2016/052647, dated Apr. 26, 2016, 2 pages, Japan Patent Office, Tokyo, Japan.
(Continued)

*Primary Examiner* — Alissa J Tompkins
*Assistant Examiner* — F Griffin Hall
(74) *Attorney, Agent, or Firm* — W. F. Fasse

(57) ABSTRACT

A midsole structure for a shoe not only maintains stability at the time of impacting the ground and improves cushioning property but also eliminates discomfort to a foot sole and improves ride feeling during running. The midsole structure (1) comprises at least two midsoles provided at a heel region of the shoe and having a hardness difference. On opposite sides of the heel region, an upper midsole (2) of a greater hardness has a thickness greater than a thickness of a lower midsole (3) of a smaller hardness. In a central part of the heel region, the lower midsole (3) of a smaller hardness has a thickness greater than a thickness of the upper midsole (2)
(Continued)

of a greater hardness. Boundary surfaces (2B, 3A) between the upper midsole (2) and the lower midsole (3) do not appear on a top surface of the midsole structure (1) (that is, a foot sole contact surface (2A) of the upper midsole (2)).

11 Claims, 19 Drawing Sheets

(51) Int. Cl.
*A43B 13/04* (2006.01)
*A43B 13/12* (2006.01)
*A43B 13/22* (2006.01)

(52) U.S. Cl.
CPC ..... *A43B 13/122* (2013.01); *A43B 13/127* (2013.01); *A43B 13/188* (2013.01); *A43B 13/223* (2013.01)

(58) Field of Classification Search
CPC ..... A43B 13/223; A43B 13/16; A43B 13/18; A43B 13/187; A43B 13/14; A43B 13/386; A43B 13/00; A43B 13/02; A43B 13/12; A43B 13/125; A43B 7/143; A43B 7/144; A43B 5/06; A43B 5/00; A43B 13/189; A43B 13/20
USPC ..... 36/30 R; 30/25 R, 28, 29, 30 A, 31
See application file for complete search history.

(56) References Cited

U.S. PATENT DOCUMENTS 7,712,231 B2 5/2010 Umezawa et al.
8,567,093 B2 * 10/2013 Sato ..... A43B 13/026 36/27
8,959,798 B2 * 2/2015 Pfister ..... A43B 7/223 36/25 R
9,131,747 B2 9/2015 Yang
2004/0154188 A1 * 8/2004 Laska ..... A43B 5/06 36/25 R
2010/0071228 A1 3/2010 Crowley, II et al.
2010/0186264 A1 7/2010 Cook et al.
2014/0075778 A1 * 3/2014 Bruce ..... A43B 13/184 36/29
2014/0215849 A1 * 8/2014 Litchfield ..... A43B 13/12 36/28
2015/0107132 A1 * 4/2015 Takeshita ..... A43B 13/18 36/28

FOREIGN PATENT DOCUMENTS

JP 2012-502735 A 2/2012
JP 2012-515621 A 7/2012
JP 2013-529535 A 7/2013
WO WO 2010/033324 3/2010

OTHER PUBLICATIONS

PCT International Preliminary Report on Patentability including English Translation of PCT Written Opinion of the International Searching Authority for International Application PCT/JP2016/052647, dated Aug. 29, 2017, 8 pages, International Bureau of WIPO, Geneva, Switzerland.

* cited by examiner

MIDSOLE STRUCTURE FOR A SHOE

TECHNICAL FIELD

The present invention relates generally to a midsole structure for a shoe, and more particularly, to an improved midsole structure that can not only maintain stability at the time of impacting the ground and improve cushioning property but also eliminate discomfort to a foot sole and improve ride feeling during running.

BACKGROUND ART

As a midsole structure for a shoe, for example, Japanese Patent Application Publication No. 2012-515621 discloses a midsole structure that comprises a shell having a central concavity formed inside an outer circumferential edge portion and an insert to be inserted into the central concavity of the shell (see paras. [0021], [0024], [0036] and FIGS. 2 to 6). Also, Japanese Patent Application Publication No. 2013-529535 discloses a midsole structure that comprises a main midsole having a slope portion, an upper midsole disposed on an upper side of the main midsole, and a lower midsole disposed on a lower side of the main midsole (see paras. [0025], [0031], [0032] and FIGS. 2 and 3).

With regard to the above midsole structure described in JP 2012-515621, in the structure of FIG. 5, the shell has a hardness greater than a hardness of the insert, and in the structure of FIG. 6, the insert has a hardness greater than a hardness of the shell. In either case, a boundary layer or interface between the shell and the insert that have a hardness difference is exposed to a top surface of the midsole. Similarly, with regard to the above midsole structure described in JP 2013-529535, as shown in a bottom drawing of FIG. 3 (or a cross sectional view of FIG. 2 taken along line C-C), a boundary layer between the main midsole and the upper midsole that have a hardness difference is exposed to a top surface of the midsole.

Therefore, according to the above-mentioned prior-art structure, in wearing a shoe as well as in impacting the ground, a foot sole of a shoe wearer contacts the boundary layer or interface between the two midsole layers having a hardness difference. Thereby, he/she may feel discomfort to the foot sole thus losing ride feeling during running.

PRIOR ART REFERENCES

Patent Documents

Patent Document 1: Japanese Patent Application Publication No. 2012-515621 (see paras. [0021], [0024], [0036] and FIGS. 2 to 6); and Patent Document 2: Japanese Patent Application Publication No. 2013-529535 (see paras. [0025], [0031], [0032] and FIGS. 2 and 3).

SUMMARY OF THE INVENTION

Objects to be Achieved by the Invention

The present invention has been made in view of those circumstances and its object to be achieved is to provide a midsole structure for a shoe that can not only maintain stability at the time of impacting the ground and improve cushioning property but also eliminate discomfort to a foot sole and improve ride feeling during running. Also, the present invention is directed to providing a midsole structure for a shoe that can equally disperse a load applied from a foot at the time of impacting the ground.

Means of Achieving the Objects

A midsole structure for a shoe according to the present invention is provided at a heel region of the shoe and comprises at least two midsoles of a hardness difference. On opposite sides of the heel region, one midsole of a greater hardness has a thickness greater than a thickness of another midsole of a smaller hardness, and in a central part of the heel region, another midsole of a smaller hardness has a thickness greater than a thickness of one midsole of a greater hardness. A boundary surface between one midsole and another midsole does not appear on a top surface of the midsole structure.

According to the present invention, since on opposite sides of the heel region, a thickness of one midsole of a greater hardness is made greater than a thickness of another midsole of a smaller hardness, a lateral leaning at the time of impacting the ground can be prevented and stability at the time of impacting the ground can be maintained. Also, since in the central part of the heel region, a thickness of another midsole of a smaller hardness is made greater than a thickness of one midsole of a greater hardness, cushioning property at the time of impacting the ground can be improved. Moreover, according to the present invention, since the boundary surface between one midsole and another midsole does not appear on the top surface of the midsole structure, a foot sole of a shoe wearer will not contact the boundary surface between the two midsole layers of a hardness difference, such that thereby he/she does not feel uncomfortable at his/her foot sole thus enhancing ride feeling during running.

One midsole of a greater hardness may be disposed on an upper side of another midsole of a smaller hardness. In this case, a load applied from a foot to the midsole structure at the time of impacting the ground can be equally dispersed by one midsole of a greater hardness thus preventing an excessive sinking of the foot.

One midsole of a greater hardness and another midsole of a smaller hardness may extend to a tread region of the shoe. On opposite sides of the tread region, a thickness of one midsole of a greater hardness may be made greater than a thickness of another midsole of a smaller hardness, and in a central part of the tread region, a thickness of another midsole of a smaller hardness may be made greater than a thickness of one midsole of a greater hardness.

In this case, since on opposite sides of the tread region, the thickness of one midsole of a greater hardness is greater than the thickness of another midsole of a smaller hardness, when a load is transferred from the heel region to the tread region and the tread region pushes off the ground, a lateral leaning of a tread region of the foot can be prevented and stability during running can be maintained. Also, since in the central part of the tread region, the thickness of another midsole of a smaller hardness is greater than the thickness of one midsole of a greater hardness, cushioning property at the tread region can be enhanced.

At the tread region, a boundary surface between one midsole and another midsole may not appear on the top surface of the midsole structure. In this case, because a ball of a foot will not contact the boundary surface between two midsole layers of a hardness difference, a shoe wearer does not feel uncomfortable at the ball of the foot thereby further enhancing ride feeling.

One midsole and another midsole may extend further forward beyond the tread region of the shoe.

At a lateral rear end portion of the heel region, another midsole of a smaller hardness may have a thickness greater than a thickness of one midsole of a greater hardness. In this case, a shock at a heel initial touch on the ground can be mitigated.

Effects of the Invention

As above-mentioned, according to the midsole structure for a shoe of the present invention, since on opposite sides of the heel region, a thickness of one midsole of a greater hardness is made greater than a thickness of another midsole of a smaller hardness, a lateral leaning at the time of impacting the ground can be prevented and stability at the time of impacting the ground can be maintained. Also, since in the central part of the heel region, a thickness of another midsole of a smaller hardness is made greater than a thickness of one midsole of a greater hardness, cushioning property at the time of impacting the ground can be improved. Moreover, since the boundary surface between one midsole and another midsole does not appear on the top surface of the midsole structure, a foot sole of a shoe wearer will not contact the boundary surface between the two midsole layers of a hardness difference, such that thereby the shoe wearer does not feel uncomfortable at his/her foot sole thus enhancing ride feeling during running.

BEST MODE FOR CARRYING OUT THE INVENTION

Figure 1:
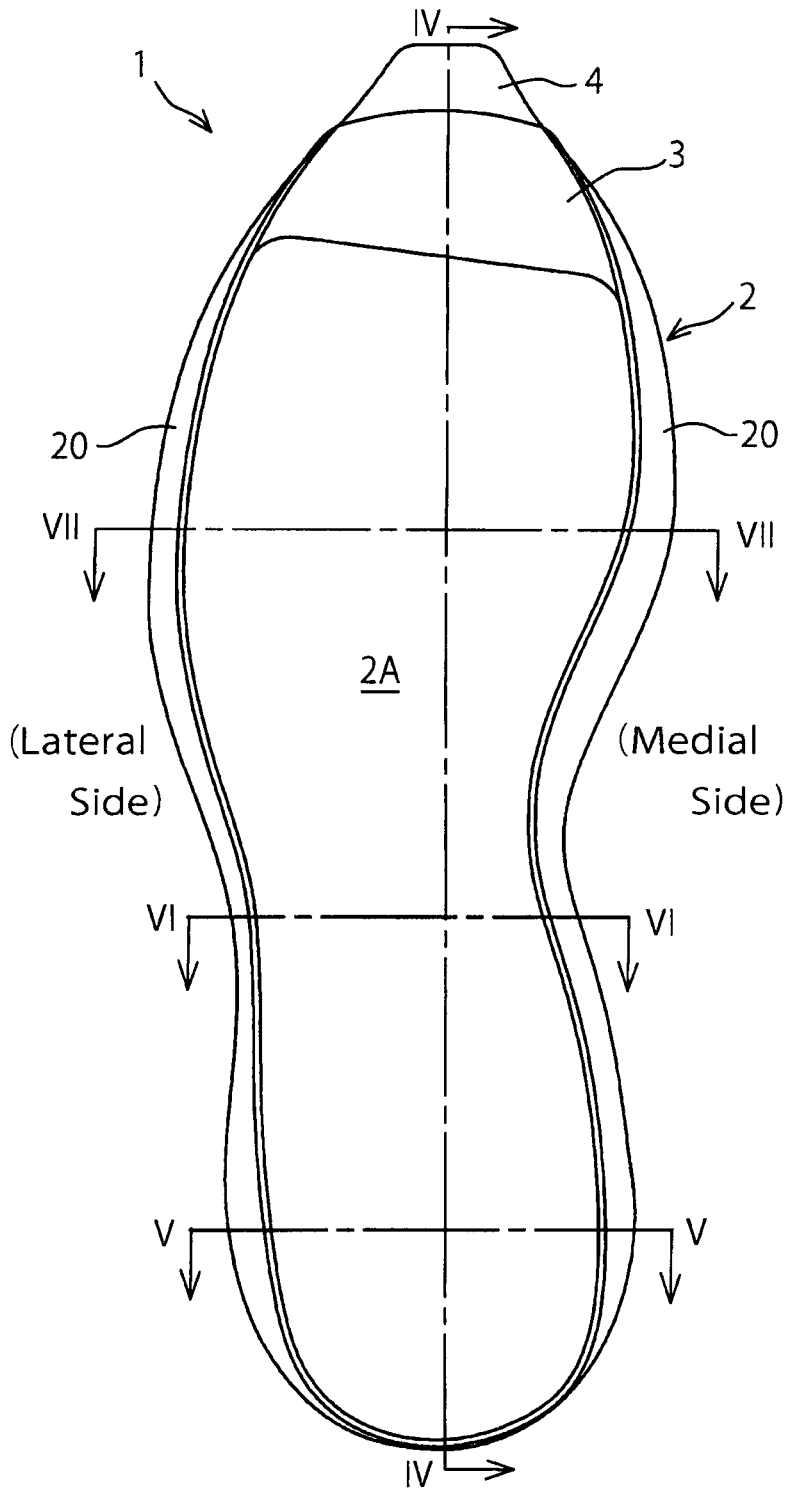
FIG. 1 is a top plan schematic view of a midsole structure for a shoe according to an embodiment of the present invention.
Figure 2:
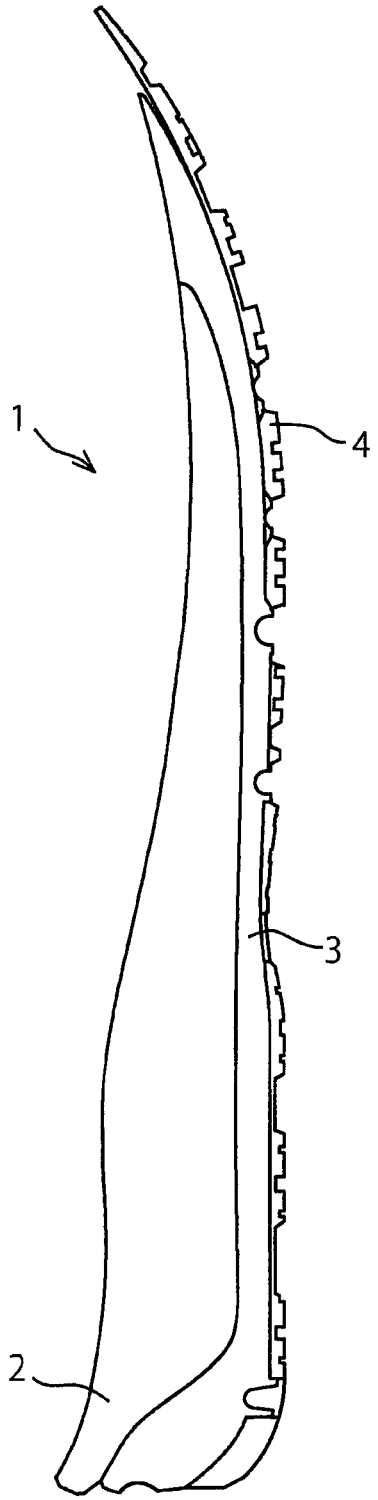
FIG. 2 is a medial side view of the midsole structure of FIG. 1.

Embodiments of the present invention will be hereinafter described in accordance with the appended drawings.

FIGS. 1 to 8 show a midsole structure for a shoe according to an embodiment of the present invention. Here, a running shoe is taken as an example of the shoe that the midsole structure of the embodiment of the present invention is applied to. In the following explanations, forward/front side/front and rearward/rear side/rear designate a positional relation of a longitudinal direction or front-back direction of a sole, upward/upper side/up and downward/lower side/down designate a positional relation of a vertical direction of the sole, and width direction designates a lateral or transverse direction of the sole. Additionally, in cross sectional views of FIGS. 4 to 8, only the midsole structure is hatched for illustration purposes.

As shown in FIGS. 1 to 4, a midsole structure 1 includes an upper midsole 2 disposed on an upper side of the midsole structure 1 and a lower midsole 3 disposed on a lower side of the midsole structure 1.

The upper midsole 2 extends longitudinally from a heel region to a tread region and the lower midsole 3 extends longitudinally from the heel region through the tread region to a toe portion. That is, in this example, a region extending from the heel region to the tread region has a two-layer structure of the upper midsole 2 and the lower midsole 3, but the toe portion has a single-layer structure of only the lower midsole 3. Respective mating surfaces of the upper and lower midsoles 2, 3 are fixedly attached to each other by bonding, double injection and the like. In the case of fixation by bonding, there is formed a bonding layer between boundary surfaces 2B and 3A, which are mating surfaces of the upper and lower midsoles 2, 3, respectively. An outsole 4 that extends from the heel region to the toe portion is fixedly attached to a lower surface of the lower midsole 3 via bonding and the like.

The upper midsole 2 includes a foot sole contact surface 2A that a foot sole of a shoe wearer contacts directly (or indirectly via an insole and the like) and an upraised portion 20 that extends upwardly from an outer circumferential edge of the foot sole contact surface 2A and that extends longitudinally.

The upper and lower midsoles 2, 3 are preferably formed respectively of first and second soft elastic materials, more specifically, thermoplastic resin such as ethylene-vinyl acetate copolymer (EVA) and the like, foamed thermoplastic resin, thermosetting resin such as polyurethane (PU) and the like, foamed thermosetting resin, rubber materials such as butadiene rubber, chloroprene rubber and the like, or foamed rubber materials.

A hardness of the second elastic material is set at 40-60 C (specifically, 50 C) in the Asker C scale for the lower midsole 3, and a hardness of the first elastic material (specifically, 55 C) for the upper midsole 2 is set greater than the hardness of the second elastic material for the lower midsole 3. A hardness difference between the upper midsole 2 and the lower midsole 3 is preferably at least 1 C in the Asker C scale. Because the first elastic material of the upper midsole 2 is harder than the second elastic material of the lower midsole 3, the midsoles are respectively also referred to herein as the "harder upper midsole 2" and the "softer lower midsole 3".

Figure 5:
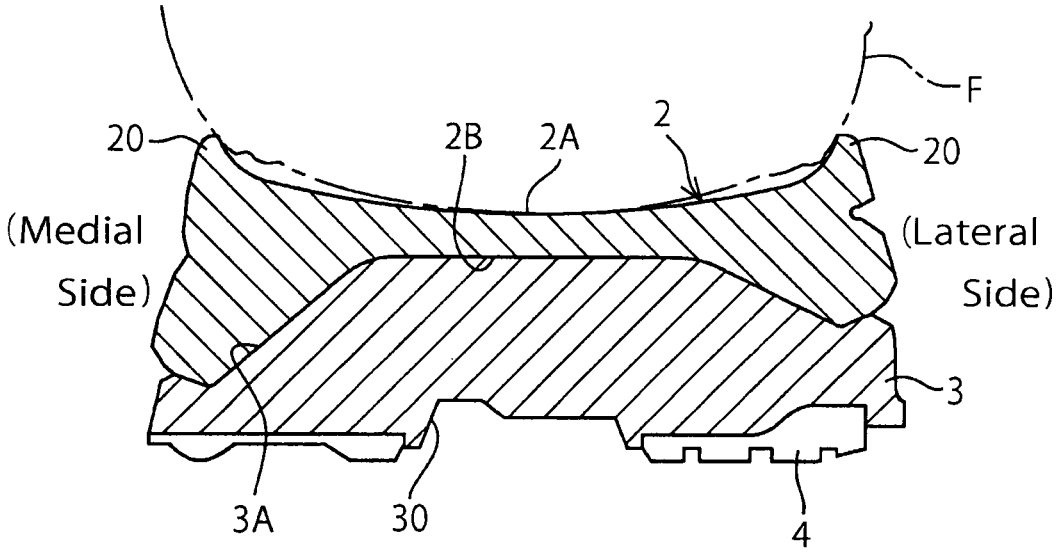
FIG. 5 is a cross sectional view of FIG. 1 taken along line V-V.

As shown in FIG. 5, which is a cross sectional view of the heel region of the midsole structure 1, i.e. a cross sectional view of FIG. 1 taken along line V-V, on opposite sides (i.e. at medial and lateral side edges) of the heel region, a thickness of the upper midsole 2 of a greater hardness (i.e. the harder upper midsole 2) is made greater than a thickness of the lower midsole 3 of a lower hardness (i.e. the softer lower midsole 3). In a central portion (i.e. the widthwise central part) of the heel region, a thickness of the lower midsole 3 of a lower hardness is made greater than a thickness of the upper midsole 2 of a greater hardness. Boundary surfaces 2B, 3A of the upper and lower midsoles 2, 3 do not appear on the foot sole contact surface 2A of the upper midsole 2, which is a top surface of the midsole structure 1. Also, in the central portion of the heel region, there is formed a concavity 30 on the bottom surface of the lower midsole 3.

Figure 6:
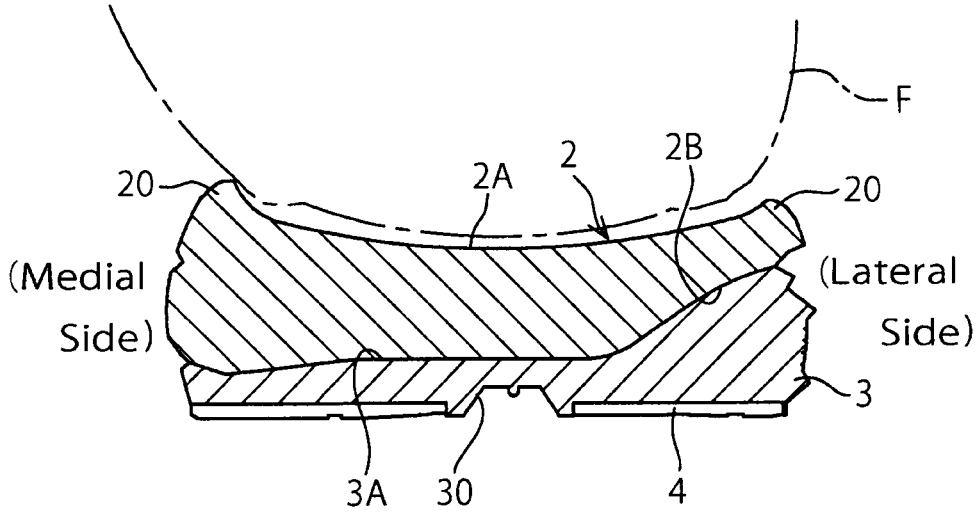
FIG. 6 is a cross sectional view of FIG. 1 taken along line VI-VI.

As shown in FIG. 6, which is a cross sectional view of a plantar arch region of the midsole structure 1, i.e. a cross sectional view of FIG. 1 taken along line VI-VI, in a region extending from the medial side of the plantar arch region to a central portion, a thickness of the upper midsole 2 of a greater hardness is made greater than a thickness of the lower midsole 3 of a lower hardness. On a lateral side of the plantar arch region, a thickness of the lower midsole 3 of a lower hardness is made greater than a thickness of the upper midsole 2 of a greater hardness. Boundary surfaces 2B, 3A of the upper and lower midsoles 2, 3 do not appear on the foot sole contact surface 2A of the upper midsole 2, which is the top surface of the midsole structure 1.

Figure 7:
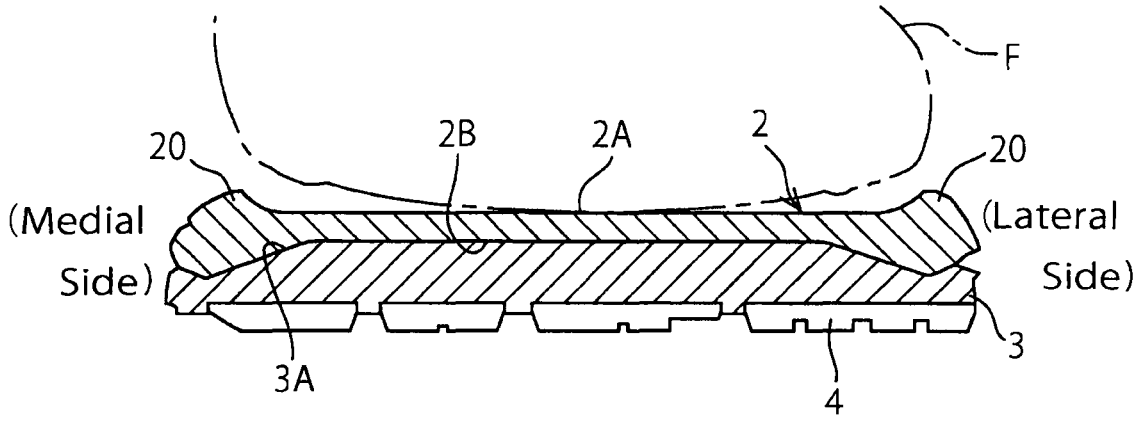
FIG. 7 is a cross sectional view of FIG. 1 taken along line VII-VII.

As shown in FIG. 7, which is a cross sectional view of a tread region of the midsole structure 1, i.e. a cross sectional view of FIG. 1 taken along line VII-VII, on opposite sides of the tread region, a thickness of the upper midsole 2 of a greater hardness is made greater than a thickness of the lower midsole 3 of a lower hardness. In a central portion of the tread region, a thickness of the lower midsole 3 of a lower hardness is made greater than a thickness of the upper midsole 2 of a greater hardness. Boundary surfaces 2B, 3A of the upper and lower midsoles 2, 3 do not appear on the foot sole contact surface 2A of the upper midsole 2, which is the top surface of the midsole structure 1.

Figure 3:
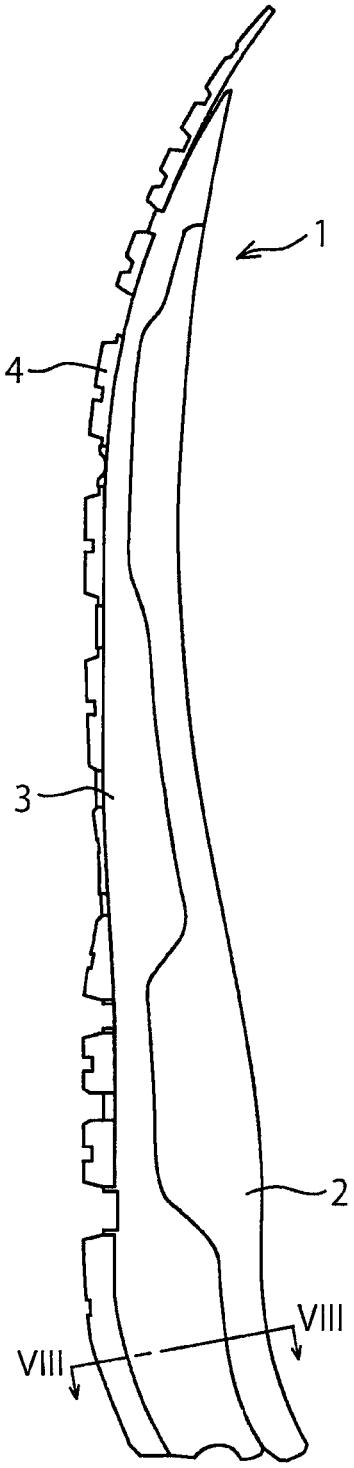
FIG. 3 is a lateral side view of the midsole structure of FIG. 1.
Figure 4:
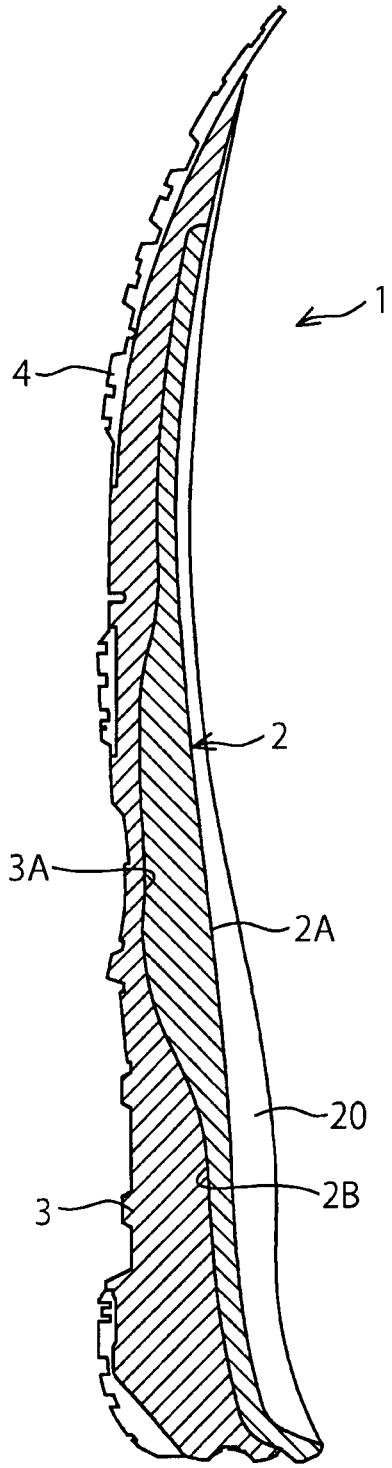
FIG. 4 is a longitudinal sectional view of FIG. 1 taken along line IV-IV.
Figure 8:
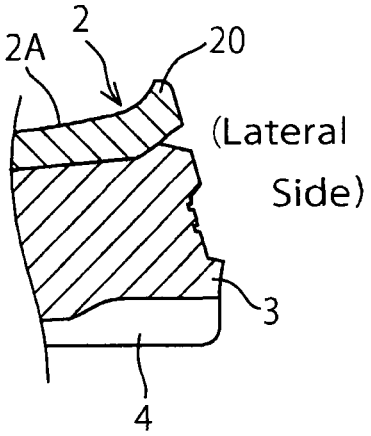
FIG. 8 is a portion of a cross sectional view of FIG. 3 taken along line VIII-VIII.

As shown in FIG. 8, which is a cross sectional view of a lateral rear end portion of the heel region of the midsole structure 1, i.e. a cross sectional view of FIG. 3 taken along line VIII-VIII, at the lateral rear end portion of the heel region, a thickness of the lower midsole 3 of a lower hardness is made greater than a thickness of the upper midsole 2 of a greater hardness.

Then, effects of the present embodiment will be explained.

As mentioned above, according to the present embodiment, on opposite sides of the heel region, the thickness of the high-hardness (i.e. harder) upper midsole 2 is greater than the thickness of the low-hardness (i.e. softer) lower midsole 3 (see FIG. 5), thereby preventing a lateral leaning of a foot F and maintaining stability at the time of impacting the ground. At the same time, in the central portion (i.e. widthwise central part) of the heel region, the thickness of the low-hardness (i.e. softer) lower midsole 3 is greater than the thickness of the high-hardness (i.e. harder) upper midsole 2 (see FIG. 5), thereby improving cushioning property at the time of impacting the ground. Since the concavity 30 is formed on the bottom surface of the lower midsole 3 in the central portion of the heel region (see FIG. 5), cushioning property can be further improved at the time of impacting the ground. Also, a midsole region corresponding to the concavity 30 is easy to deform downwardly at the time of a heel-impact onto the ground and in conjunction with such a downward deformation of the midsole region, the upraised portions 20 on the opposite sides of the upper midsole 2 deform to lean toward a heel central side, such that thereby the upraised portions 20 hold a heel of the foot from opposite sides thereof, thus preventing the lateral leaning of the foot F more securely at the time of the heel-impact onto the ground.

Moreover, according to the present embodiment, since the boundary surfaces 2B, 3A between the high-hardness upper midsole 2 and the low-hardness lower midsoles 3 at the heel region do not appear on the foot sole contact surface 2A of the upper midsole 2 (see FIG. 5), which is the top surface of the midsole structure 1, the foot sole of the shoe wearer does not contact the boundary surfaces of the two midsole layers of a hardness difference, such that thereby the shoe wearer does not feel uncomfortable at the foot sole, thus enhancing ride feeling during running.

Also, in the present embodiment, because the high-hardness upper midsole 2 is disposed on the upper side of the low-hardness lower midsole 3 (see FIG. 5), load applied from the foot F to the midsole structure 1 at the time of impacting the ground can be equally dispersed by the high-hardness upper midsole 2 thus preventing an excessive sinking of the foot F.

Furthermore, according to the present embodiment, the upper and lower midsoles 2, 3 extend to the tread region of the midsole structure 1 (see FIG. 1) and on opposite sides of the tread region, the thickness of the high-hardness upper midsole 2 is greater than the thickness of the low-hardness lower midsole 3 (see FIG. 7), such that thereby when load is transferred from the heel region to the tread region and at the time of push-off motion of the tread region, a lateral leaning of a tread portion of the foot F can be prevented and stability during running can be maintained. At the same time, in the central portion of the tread region, the thickness of the low-hardness lower midsole 3 is greater than the thickness of the high-hardness upper midsole 2 (see FIG. 7), thereby improving cushioning property of the tread region.

Also, in the present embodiment, the boundary surfaces 2B, 3A of the high-hardness upper midsole 2 and the low-hardness lower midsoles 3 at the tread region do not appear on the foot sole contact surface 2A of the upper midsole 2 (see FIG. 7), which is the top surface of the midsole structure 1, such that thereby the tread portion of the foot F does not contact the boundary surfaces of the two midsole layers of a hardness difference and the shoe wearer does not feel uncomfortable at the tread portion thus improving ride feeling during running.

Moreover, in the present embodiment, at the lateral rear end portion (i.e. an initial ground contact area) of the heel region, the low-hardness (i.e. softer) lower midsole 3 has the thickness greater than the thickness of the high-hardness (i.e. harder) upper midsole 2 (see FIG. 8), thus mitigating shock at the time of an initial touch of the heel to the ground.

The preferred embodiment of the present invention has been thus explained, but application of the present invention is not limited to such an embodiment and the invention includes various alternative embodiments. Some of the alternative embodiments will be shown below. In drawings that show the alternative embodiments, like reference numerals indicate identical or functionally similar elements.

First Alternative Embodiment

In the above-mentioned embodiment, an example in which the lower midsole 3 extends longitudinally from the heel region through the tread region to the toe portion (i.e. a full-length type) was shown, but application of the present invention is not limited to such an embodiment. FIGS. 9 to 17 show a first alternative embodiment of the present invention.

As shown in FIGS. 9 to 12, the lower midsole 3 is disposed at the heel region. The upper midsole 2 extends longitudinally from the heel region through the tread region to the toe portion. That is, in this exemplification, the heel region has a two-layer structure formed of the upper midsole 2 and the lower midsole 3 and the other regions have a single-layer structure of the upper midsole 2. A front end edge portion 3*a* of the lower midsole 3 may extend to a rear end portion of the plantar arch region and the front end edge portion 3*a* may have a different shape other than that shown in FIG. 9. At medial and lateral rear end portions of the heel region, an outsole 4 is fixedly attached to the bottom surface of the lower midsole 3 through bonding or the like. At the other portions of the heel region, an outsole 4 is fixedly attached to the bottom surfaces of the upper and lower midsoles 2, 3 through bonding or the like. At the plantar arch and tread regions, an outsole 4 is fixedly attached to the bottom surfaces of the upper midsole 2 through bonding or the like.

As with the above-mentioned embodiment, a hardness of the upper and lower midsoles 2, 3 is set at 40-60 C (specifically, 50 C) in the Asker C scale for the lower midsole 3 and at a hardness (specifically, 55 C) greater than the hardness of the lower midsole 3 for the upper midsole 2. A hardness difference between the upper midsole 2 and the lower midsole 3 is preferably at least 1 C in the Asker C scale.

Figure 9:
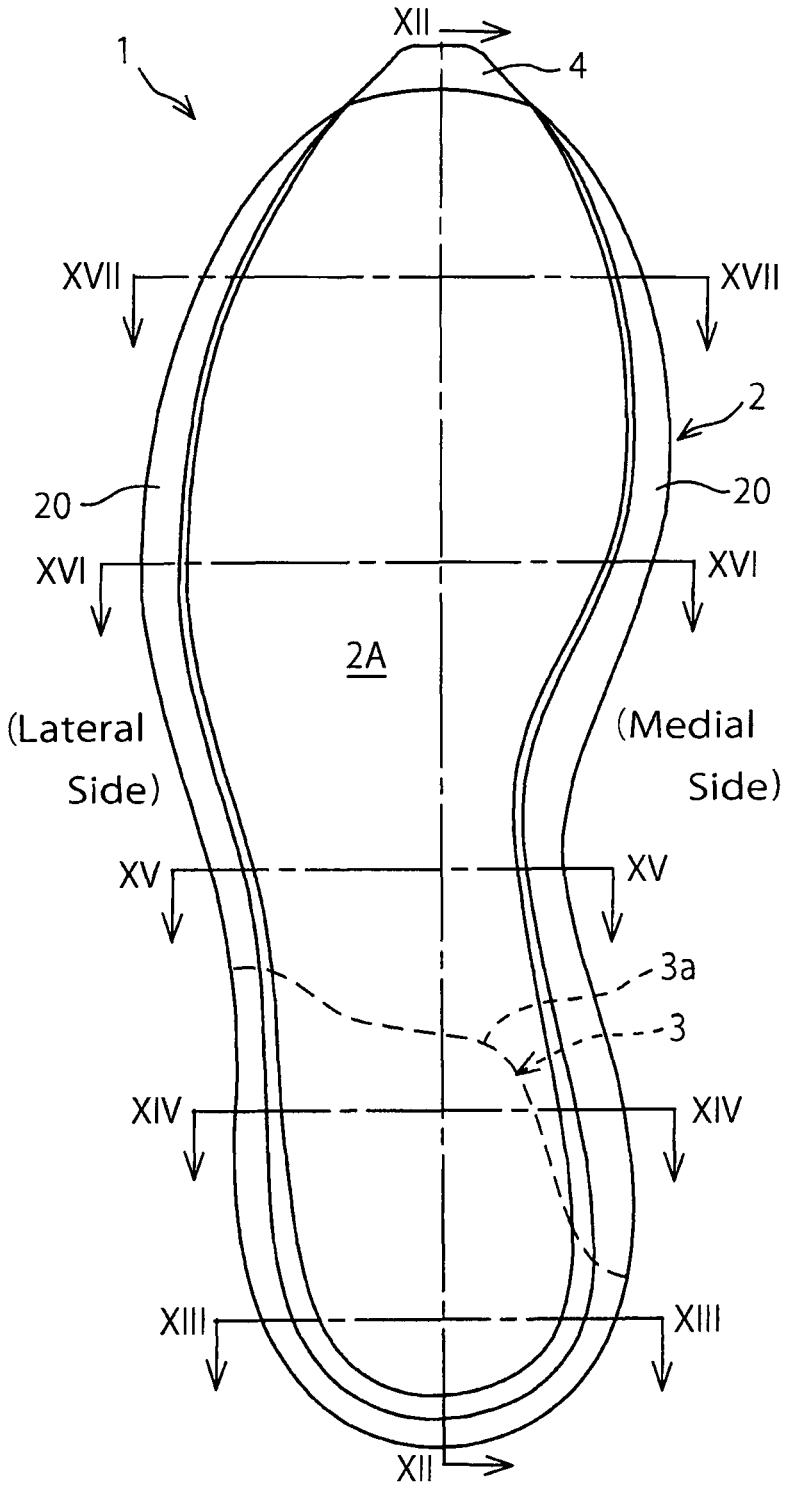
FIG. 9 is a top plan schematic view of a midsole structure for a shoe according to a first alternative embodiment of the present invention.
Figure 10:
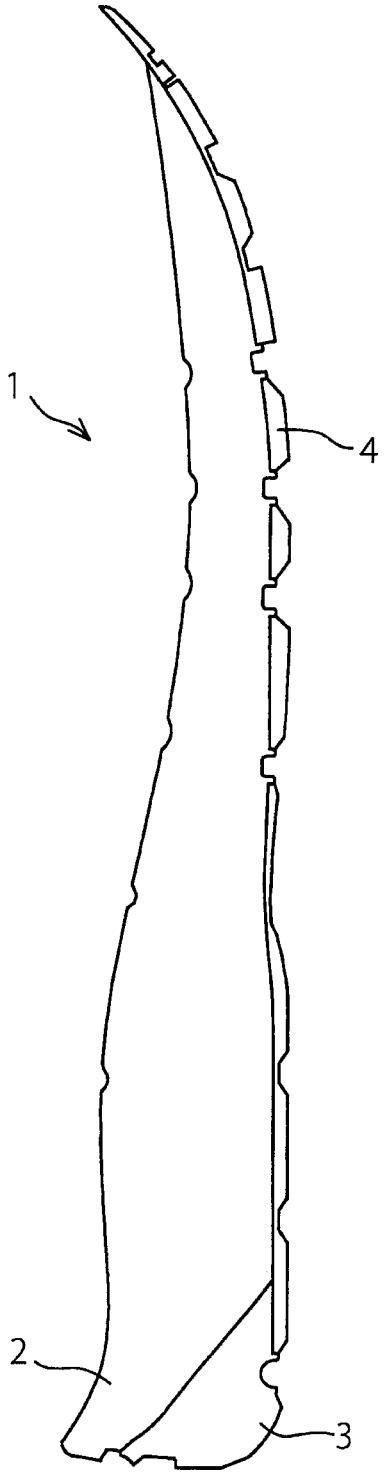
FIG. 10 is a medial side view of the midsole structure of FIG. 9.
Figure 11:
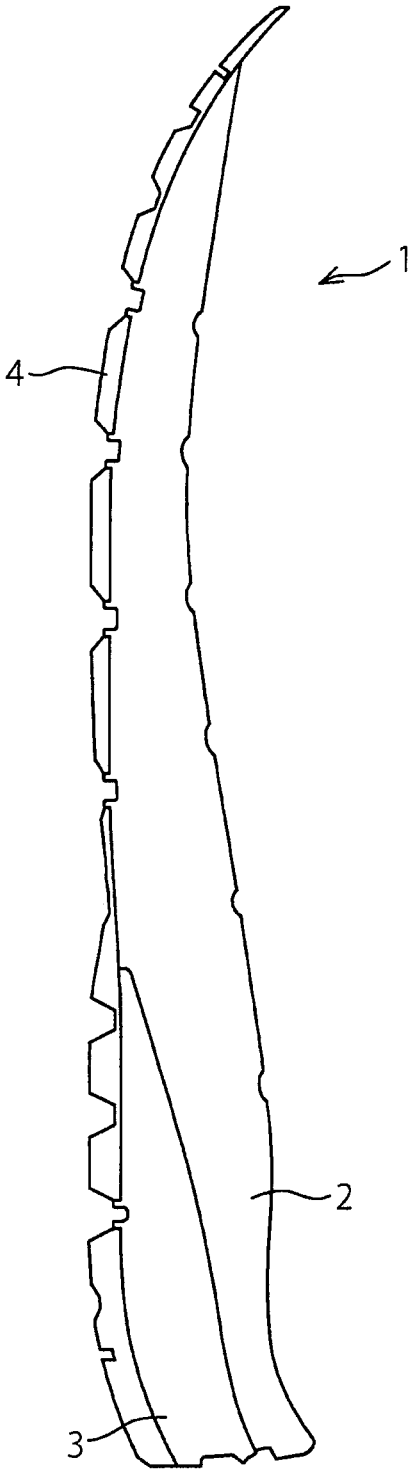
FIG. 11 is a lateral side view of the midsole structure of FIG. 9.
Figure 12:
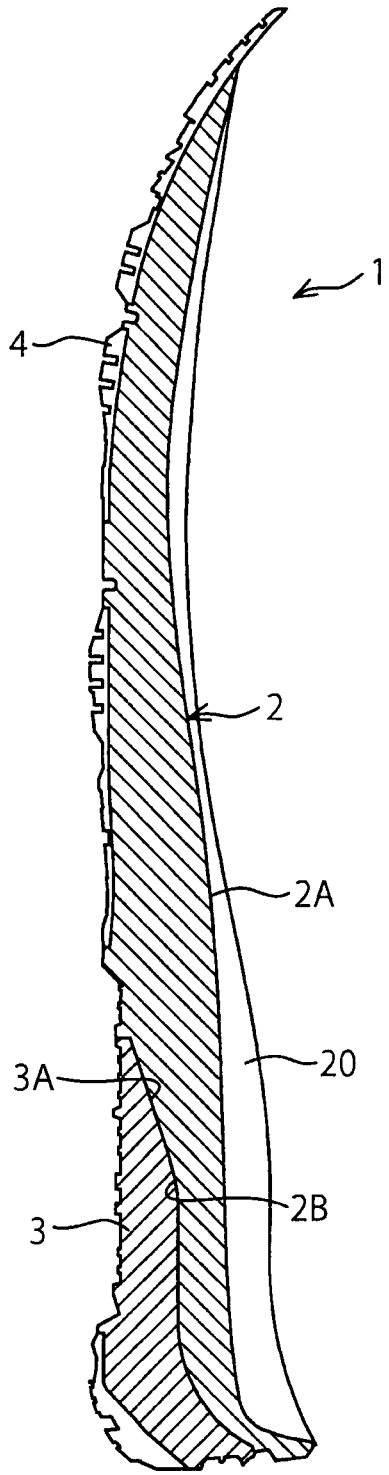
FIG. 12 is a longitudinal sectional view of FIG. 9 taken along line XII-XII.
Figure 13:
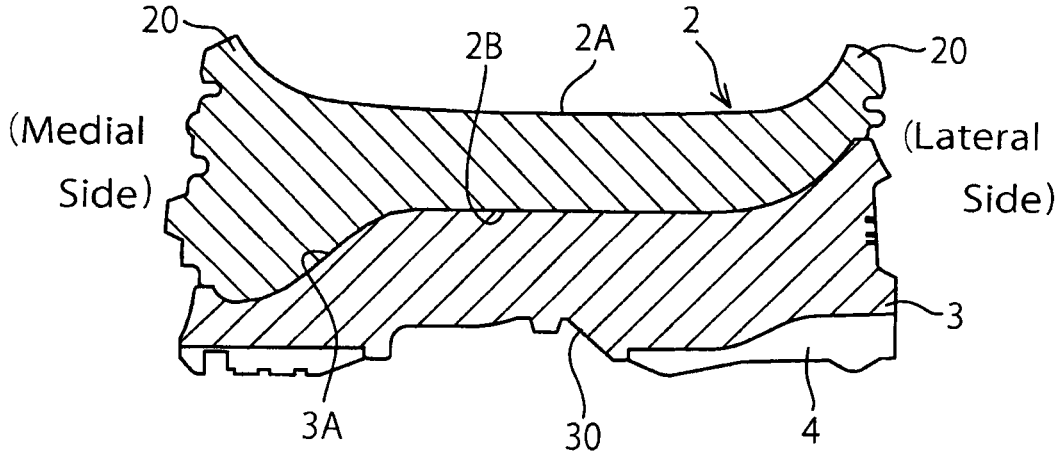
FIG. 13 is a cross sectional view of FIG. 9 taken along line XIII-XIII.
Figure 14:
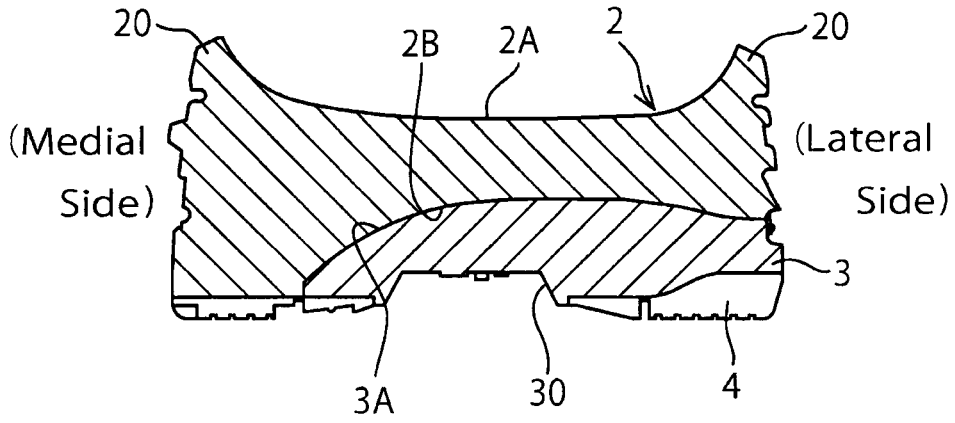
FIG. 14 is a cross sectional view of FIG. 9 taken along line XIV-XIV.

As shown in FIG. 13, which is a cross sectional view of the heel region of the midsole structure 1, i.e. a cross sectional view of FIG. 9 taken along line XIII-XIII, on a medial side of the heel region, a thickness of the high-hardness upper midsole 2 is greater than a thickness of the low-hardness lower midsole 3. In a central portion of the heel region, a thickness of the low-hardness lower midsole 3 is greater than a thickness of the high-hardness upper midsole 2. Since the cross section shown in FIG. 13 includes a cross section of a lateral rear end portion of the heel region, i.e. an initial touch region of the heel on the ground also called an initial ground-contact area herein, at a lateral side of the heel region, a thickness of the low-hardness lower midsole 3 is greater than a thickness of the high-hardness upper midsole 2. However, on a lateral side other than the lateral rear end portion of the heel region, as shown in FIG. 14 (i.e. a cross sectional view of FIG. 9 taken along line XIV-XIV), a thickness of the high-hardness upper midsole 2 is greater than a thickness of the low-hardness lower midsole 3. Similar to the above-mentioned embodiment, boundary surfaces 2B, 3A of the upper and lower midsoles 2, 3 do not appear on the foot sole contact surface 2A of the upper midsole 2, which is the top surface of the midsole structure 1. Also, in the central portion of the heel region, there is formed a concavity 30 on the bottom surface of the lower midsole 3.

Figure 15:
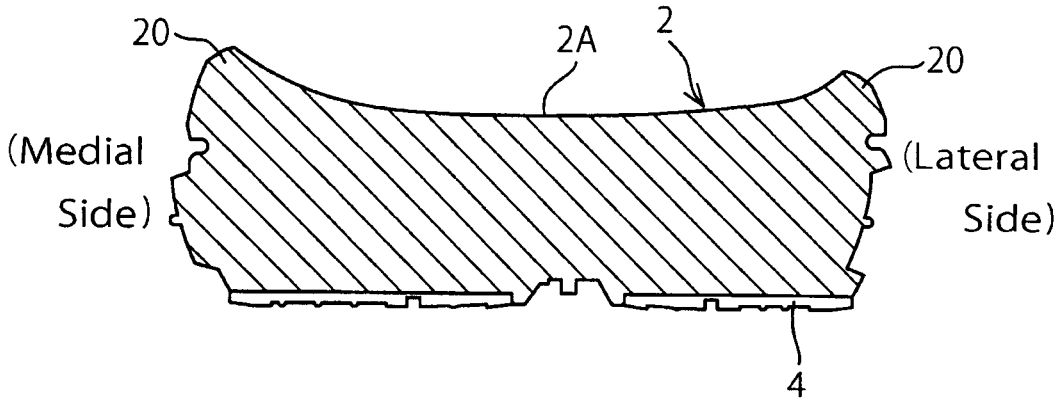
FIG. 15 is a cross sectional view of FIG. 9 taken along line XV-XV.
Figure 16:
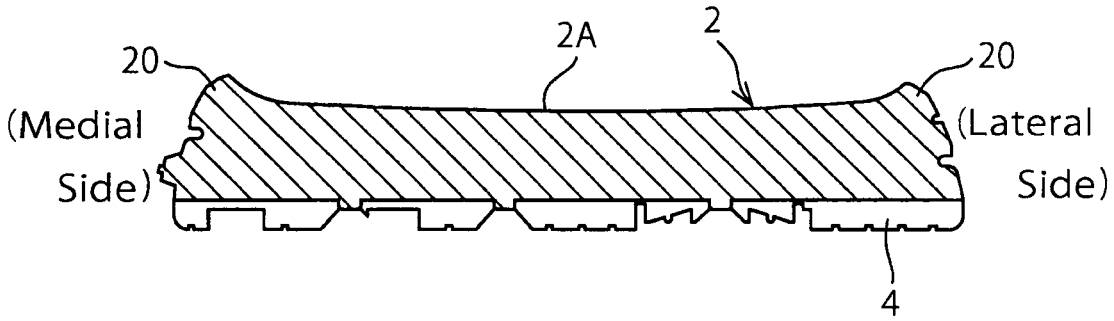
FIG. 16 is a cross sectional view of FIG. 9 taken along line XVI-XVI.
Figure 17:
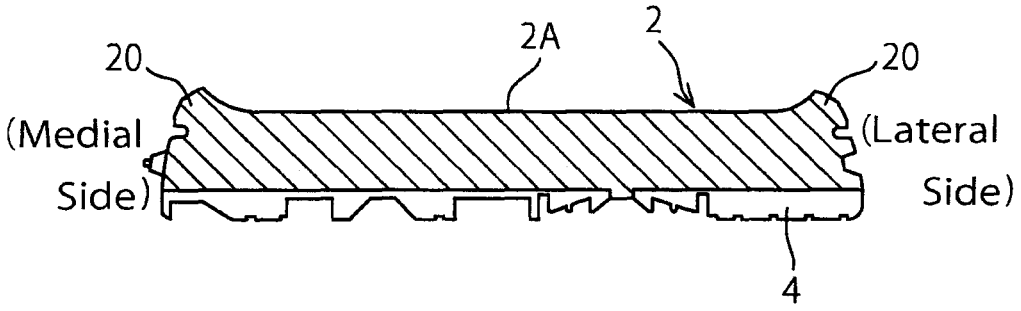
FIG. 17 is a cross sectional view of FIG. 9 taken along line XVII-XVII.
Figure 18:
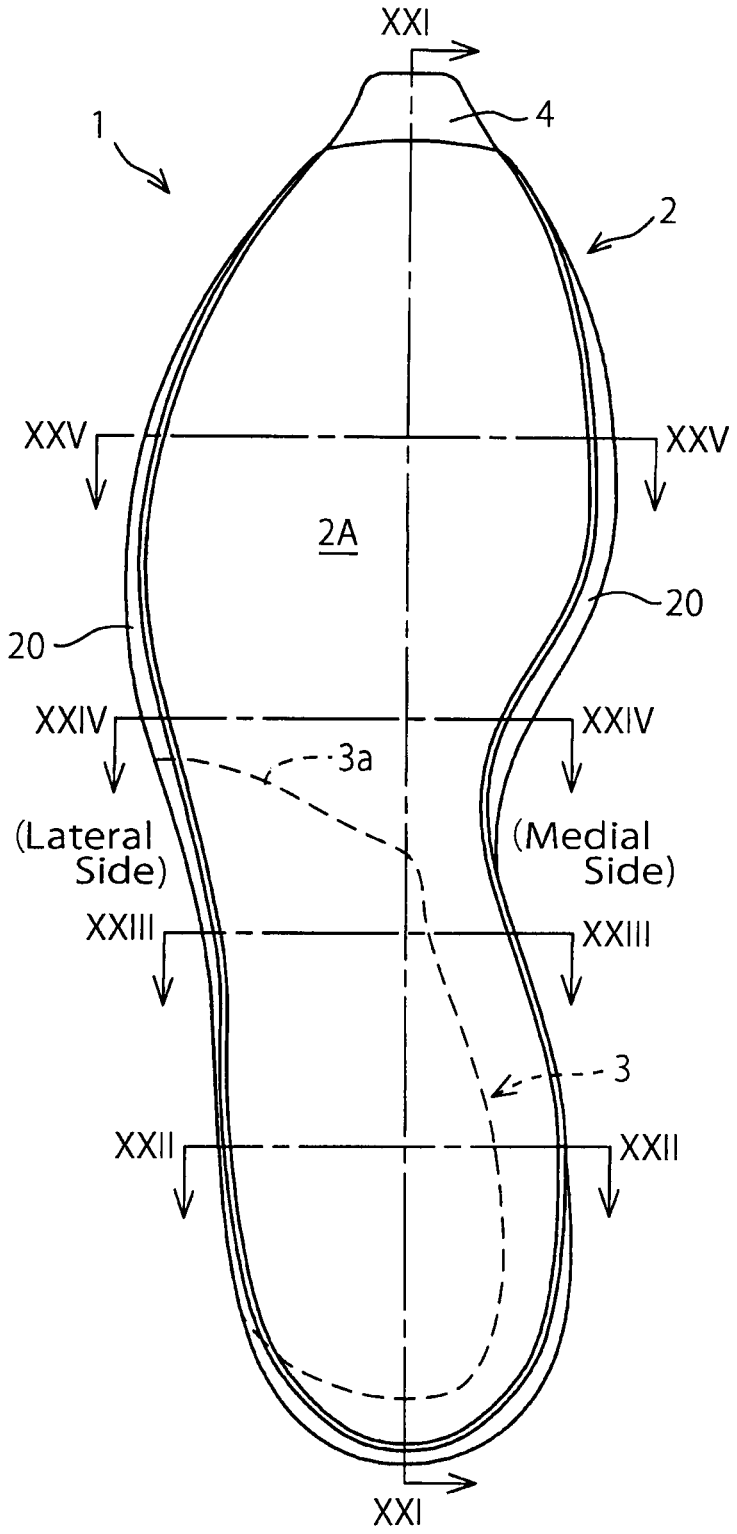
FIG. 18 is a top plan schematic view of a midsole structure for a shoe according to a second alternative embodiment of the present invention.
Figure 19:
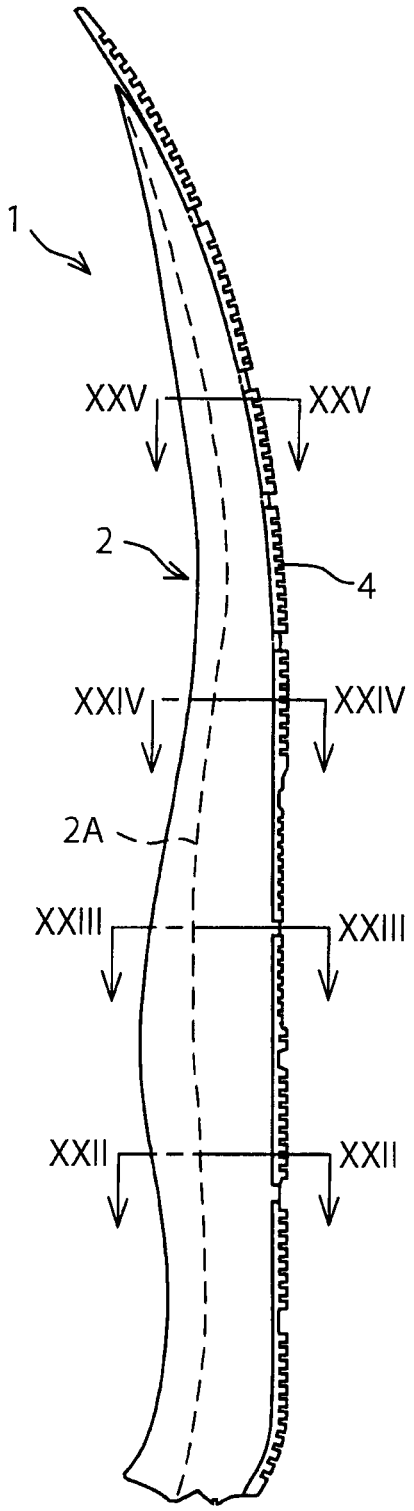
FIG. 19 is a medial side view of the midsole structure of FIG. 18.
Figure 20:
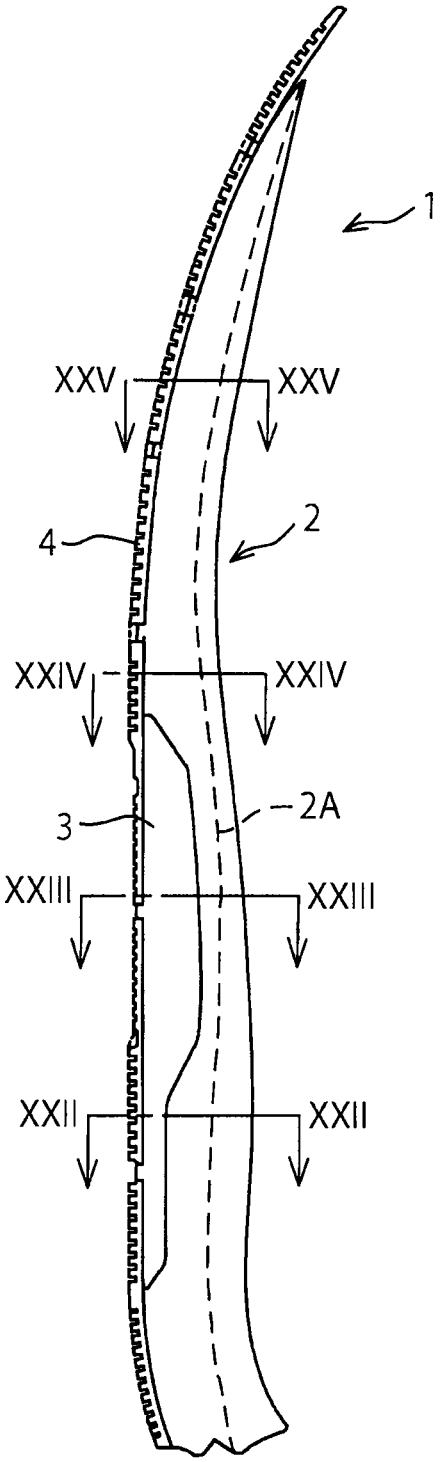
FIG. 20 is a lateral side view of the midsole structure of FIG. 18.
Figure 21:
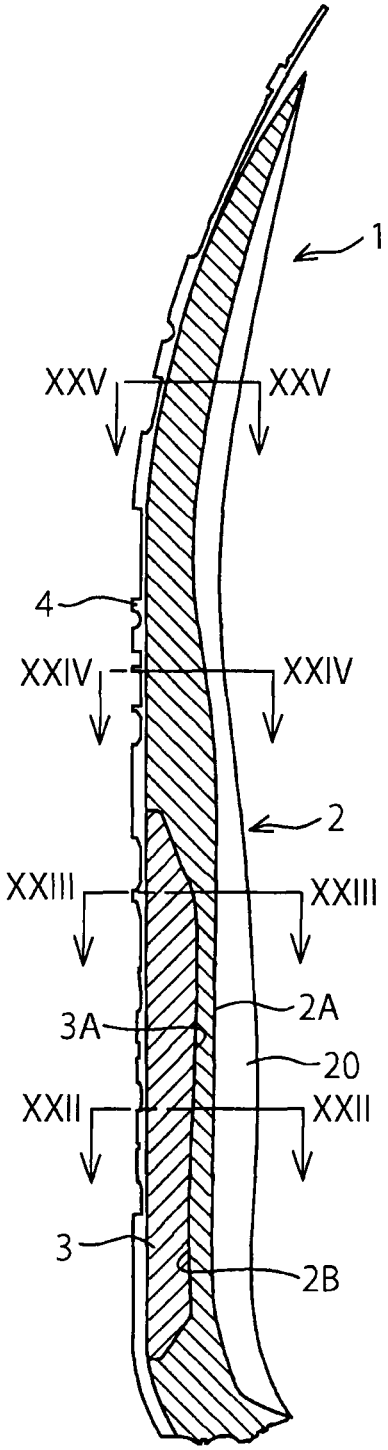
FIG. 21 is a longitudinal sectional view of FIG. 18 taken along line XXI-XXI.

As shown in FIG. 15, which is a cross sectional view of FIG. 9 taken along line XV-XV illustrating a cross section of the plantar arch region, only the high-hardness upper midsole 2 is provided at the plantar arch region. Similarly, at the tread region, as shown in FIG. 16, i.e a cross sectional view of FIG. 9 taken along line XVI-XVI illustrating a cross section of a rear end of the tread region, and FIG. 17, i.e a cross sectional view of FIG. 9 taken along line XVII-XVII illustrating a cross section of a front end of the tread region, only the high-hardness upper midsole 2 is provided.

As with the above-mentioned embodiment, in this first alternative embodiment as well, on opposite sides of the heel region, the thickness of the high-hardness upper midsole 2 is greater than the thickness of the low-hardness lower midsole 3 (see FIGS. 13 and 14), thereby preventing a lateral leaning of the foot F and maintaining stability at the time of impacting the ground. Also, in the central portion of the heel region, the thickness of the low-hardness lower midsole 3 is greater than the thickness of the high-hardness upper midsole 2 (see FIG. 13), thereby improving cushioning property at the time of a heel-impact on the ground. Also, since the concavity 30 is formed on the bottom surface of the lower midsole 3 in the central portion of the heel region (see FIG. 14), cushioning property can be further improved at the time of impacting the ground. At the same time, a midsole region corresponding to the concavity 30 is easy to deform downwardly at the time of a heel-impact onto the ground and also in conjunction with such a downward deformation of the midsole region, the upraised portions 20 on the opposite sides of the upper midsole 2 deform to lean toward a heel central side, such that thereby the upraised portions 20 hold a heel of the foot from opposite sides thereof, thus preventing the lateral leaning of the foot F more securely at the time of the heel-impact onto the ground.

Moreover, since the boundary surfaces 2B, 3A between the high-hardness upper midsole 2 and the low-hardness lower midsoles 3 at the heel region do not appear on the foot sole contact surface 2A of the upper midsole 2 (see FIGS. 13, 14), which is the top surface of the midsole structure 1, the foot sole of the shoe wearer does not contact the boundary surfaces of the two midsole layers of a hardness difference, such that thereby the shoe wearer does not feel uncomfortable at the foot sole, thus enhancing ride feeling during running.

Furthermore, because the high-hardness upper midsole 2 is disposed on the upper side of the low-hardness lower midsole 3 (see FIGS. 13, 14), load applied from the foot F to the midsole structure 1 at the time of impacting the ground can be equally dispersed by the high-hardness upper midsole 2 thus preventing an excessive sinking of the foot F.

Also, at the lateral rear end portion of the heel region, the low-hardness lower midsole 3 has a thickness greater than a thickness of the high-hardness upper midsole 2 (see FIG. 13), thus mitigating shock at the time of an initial touch of the heel on the ground.

In addition, at the medial side excluding the medial rear end portion of the heel region, only the high-hardness upper midsole 2 is provided and there is no boundary surface relative to the low-hardness lower midsole 3 (see FIG. 14). As a result, at the medial side excluding the medial rear end portion of the heel region, a risk of peeling-off of the lower midsole 3 from the upper midsole 2 can be eliminated. At the same time, the quantity of low-hardness lower midsole 3, which is comparatively costly relative to the high-hardness upper midsole 2, can be lessened, thus reducing a manufacturing cost of the midsole structure 1. Also, since there are no boundary surfaces 2B, 3A of the upper and lower midsoles 2, 3 formed at the medial side excluding the medial rear end portion of the heel region, the boundary surface 2B of the upper midsole 2 at the heel region has a concave shape and the boundary surface 3A of the lower midsole 3 has a convex shape that corresponds to the concavely-shaped boundary surface 2B of the upper midsole 2 (see FIG. 14). Thereby, when the lower midsole 3 is bonded to the boundary surface 2B of the upper midsole 2, positioning of the lower midsole 3 relative to the upper midsole 2 can be made easy utilizing the corresponding concave and convex shapes of the boundary surfaces 2B, 3A of the upper and lower midsoles 2, 3 thus facilitating an assembly work of the midsole.

Second Alternative Embodiment

In the above-mentioned embodiment, an example in which the lower midsole 3 extends longitudinally from the heel region through the tread region to the toe portion (i.e. a full-length type) was shown, but application of the present invention is not limited to such an embodiment. FIGS. 18 to 25 show a second alternative embodiment of the present invention.

As shown in FIGS. 18 to 21, the lower midsole 3 is disposed at a region extending from the heel region to the plantar arch region. The upper midsole 2 extends longitudinally from the heel region through the tread region to the toe portion. That is, in this exemplification, the heel region and the plantar arch region have a two-layer structure formed of the upper midsole 2 and the lower midsole 3 and the other regions have a single-layer structure of the upper midsole 2. Also, at a region extending from a lateral rear end portion through a medial rear end portion to the medial side of the heel region, an outer circumferential edge portion of the lower midsole 3 does not extend to the outer circumferential portion of the midsole structure 1. At the outer circumferential portion of the region extending from the lateral rear end portion through the medial rear end portion to the medial side of the heel region, only the upper midsole 2 appears. A front end edge portion 3*a* of the lower midsole 3 may extend to a front end portion of the plantar arch region and the front end edge portion 3*a* may have a different shape other than that shown in FIG. 18. At the heel and plantar arch regions, the outsole 4 is fixedly attached to the bottom surfaces of the upper and lower midsoles 2, 3 through bonding or the like. At the other regions, the outsole 4 is fixedly attached to the bottom surface of the upper midsole 2 through bonding or the like.

As with the above-mentioned embodiment, a hardness of the upper and lower midsoles 2, 3 is set at 40-60 C (specifically, 50 C) in the Asker C scale for the lower midsole 3 and at a hardness (specifically, 55 C) greater than the hardness of the lower midsole 3 for the upper midsole 2. A hardness difference between the upper midsole 2 and the lower midsole 3 is preferably at least 1 C in the Asker C scale.

Figure 22:
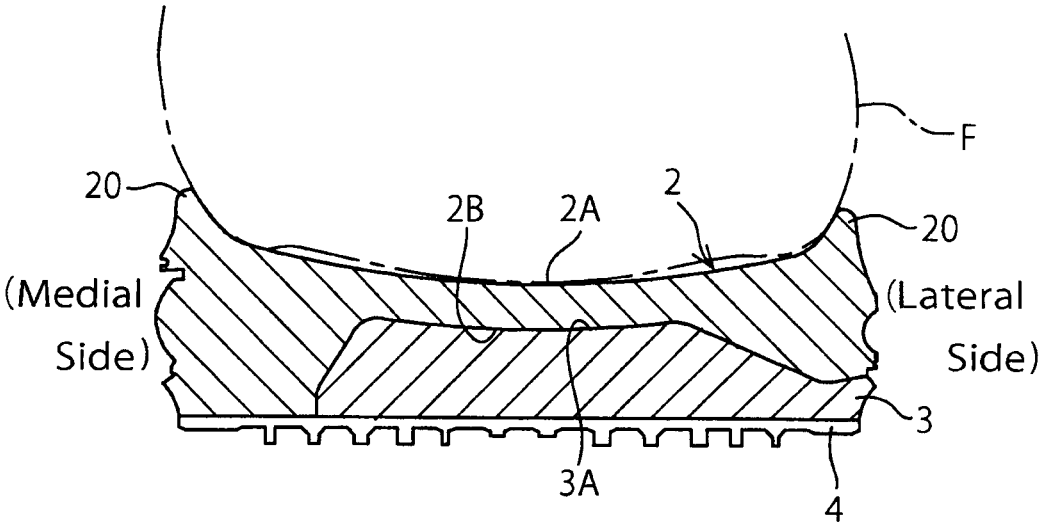
FIG. 22 is a cross sectional view of FIGS. 18 to 21 taken along line XXII-XXII.

As shown in FIG. 22, which is a cross sectional view of the heel region of the midsole structure 1, i.e. a cross sectional view of FIGS. 18 to 21 taken along line XXII-XXII, on a medial side and a lateral side of the heel region, a thickness of the high-hardness upper midsole 2 is greater than a thickness of the low-hardness lower midsole 3. In a central portion of the heel region, a thickness of the low-hardness lower midsole 3 is greater than a thickness of the high-hardness upper midsole 2. Similar to FIG. 14 in the first alternative embodiment, on the medial side of the heel region, a thickness of the lower midsole 3 is zero and the medial side of the heel region is thus formed of only the upper midsole 2. As with the above-mentioned embodiment, boundary surfaces 2B, 3A of the upper and lower midsoles 2, 3 do not appear on the foot sole contact surface 2A of the upper midsole 2, which is a top surface of the midsole structure 1.

Figure 23:
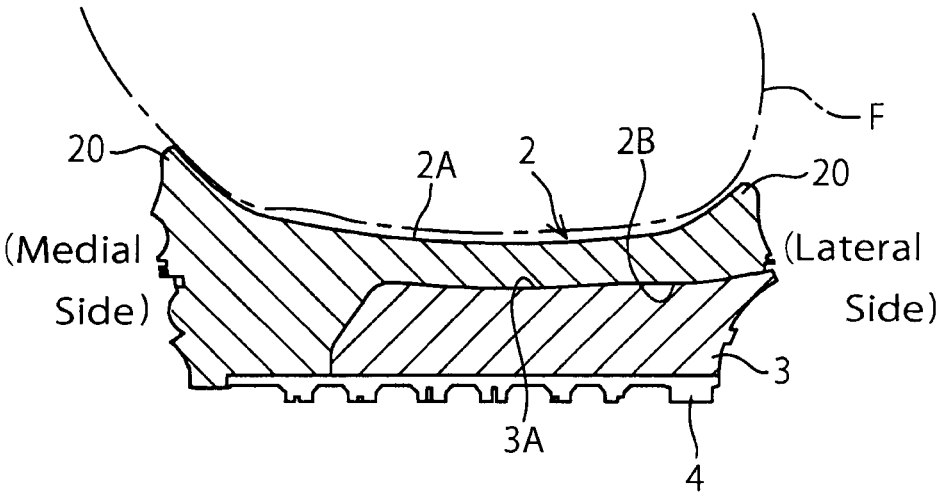
FIG. 23 is a cross sectional view of FIGS. 18 to 21 taken along line XXIII-XXIII.

As shown in FIG. 23, which is a cross sectional view of the rear end side of the plantar arch region of the midsole structure 1, i.e. a cross sectional view of FIGS. 18 to 21 taken along line XXIII-XXIII, on a medial side of the plantar arch region, a thickness of the high-hardness upper midsole 2 is greater than a thickness of the low-hardness lower midsole 3 (or the thickness of the lower midsole 3 is zero). In a region extending from a central portion to a lateral side of the plantar arch region, a thickness of the low-hardness lower midsole 3 is greater than a thickness of the high-hardness upper midsole 2. Also, boundary surfaces 2B, 3A of the upper and lower midsoles 2, 3 do not appear on the foot sole contact surface 2A of the upper midsole 2, which is a top surface of the midsole structure 1.

Figure 24:
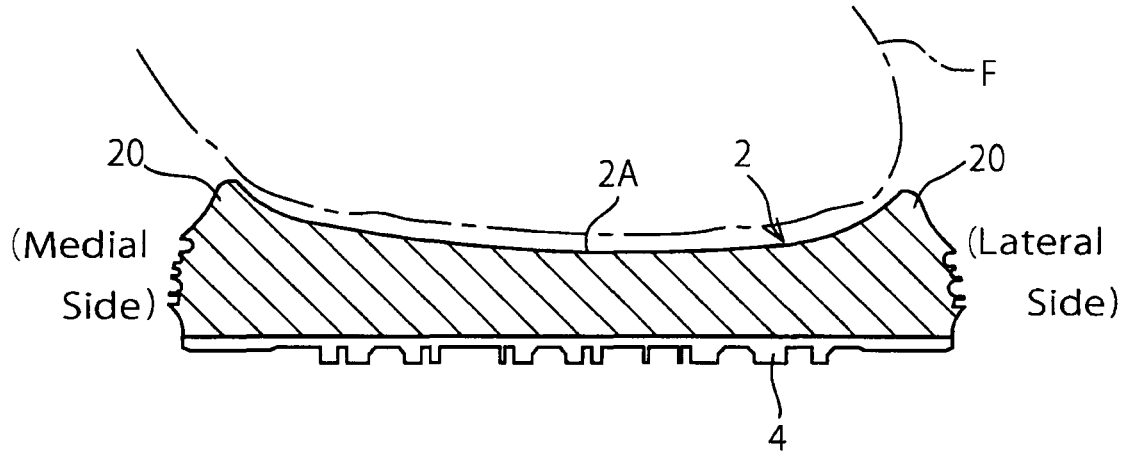
FIG. 24 is a cross sectional view of FIGS. 18 to 21 taken along line XXIV-XXIV.
Figure 25:
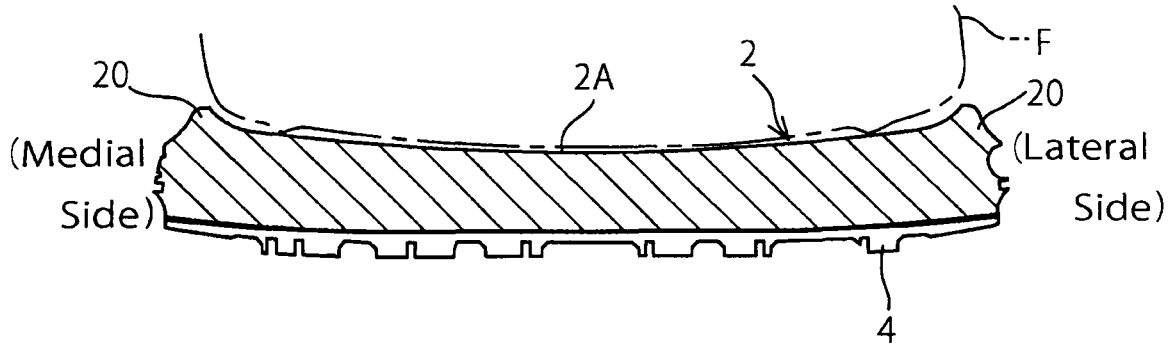
FIG. 25 is a cross sectional view of FIGS. 18 to 21 taken along line XXV-XXV.

As shown in FIG. 24, which is a cross sectional view of FIGS. 18 to 21 taken along line XXIV-XXIV illustrating across section of a front end side of the plantar arch region, only the high-hardness upper' midsole 2 is provided on the front side of the plantar arch region. Similarly, at the tread region, as shown in FIG. 25, or a cross sectional view of FIGS. 18 to 21 taken along line XXV-XXV illustrating a cross section of the tread region, only the high-hardness upper midsole 2 is provided.

As with the above-mentioned embodiment, in this second alternative embodiment as well, on opposite sides of the heel region, the thickness of the high-hardness upper midsole 2 is greater than the thickness of the low-hardness lower midsole 3 (see FIG. 22), thereby preventing a lateral leaning of the foot F at the time of a heel-impact on the ground and maintaining stability at the time of impacting the ground. Also, in the central portion of the heel region, the thickness of the low-hardness lower midsole 3 is greater than the thickness of the high-hardness upper midsole 2 (see FIG. 22), thereby improving cushioning property at the time of the heel-impact on the ground.

Moreover, since the boundary surfaces 2B, 3A between the high-hardness upper midsole 2 and the low-hardness lower midsoles 3 at the heel region do not appear on the foot sole contact surface 2A of the upper midsole 2 (see FIG. 22), which is the top surface of the midsole structure 1, a foot sole of the shoe wearer does not contact the boundary surfaces of the two midsole layers of a hardness difference, such that thereby the shoe wearer does not feel uncomfortable at the foot sole, thus enhancing ride feeling during running.

Furthermore, because the high-hardness upper midsole 2 is disposed on the upper side of the low-hardness lower midsole 3 (see FIG. 22), load applied from the foot F to the midsole structure 1 at the time of impacting the ground can be equally dispersed by the high-hardness upper midsole 2 thus preventing an excessive sinking of the foot F.

In addition, at a region extending from a lateral rear end portion through a medial rear end portion to a medial side of the heel region and another region on the medial side of the plantar arch region, only the high-hardness upper midsole 2 is provided and there is no boundary surface relative to the low-hardness lower midsole 3 (see FIGS. 22 and 23). As a result, at these regions, a risk of peeling-off of the lower midsole 3 from the upper midsole 2 can be eliminated. At the same time, the quantity of low-hardness lower midsole 3, which is comparatively costly relative to the high-hardness upper midsole 2, can be lessened, thus reducing a manufacturing cost of the midsole structure 1. On a medial side of a region extending from the plantar arch region to the tread region, the low-hardness lower midsole 3 is not provided and only the high-harness upper midsole 2 is provided (see FIGS. 23 to 25), thus further improving stability of the midsole structure 1.

Also, since there are no boundary surfaces 2B, 3A of the upper and lower midsoles 2, 3 formed at the medial side of the heel region, the boundary surface 2B of the upper midsole 2 at the heel region has a concave shape and the boundary surface 3A of the lower midsole 3 has a convex shape that corresponds to the concavely-shaped boundary surface 2B of the upper midsole 2 (see FIGS. 22 and 23). Thereby, when the lower midsole 3 is bonded to the boundary surface 2B of the upper midsole 2, positioning of the lower midsole 3 relative to the upper midsole 2 can be made easy utilizing the corresponding concave and convex shapes of the boundary surfaces 2B, 3A of the upper and lower midsoles 2, 3 thus facilitating an assembly work of the midsole.

Third Alternative Embodiment

In the above-mentioned embodiment and first and second alternative embodiments, an example in which the midsole structure 1 is formed of two layers of the high-hardness upper midsole 2 and the low-hardness lower midsole 3 was shown, but in the present invention, the midsole structure 1 may be formed of three or more layers of the midsoles.

Another Variant

The above-mentioned embodiment and respective variants are to be considered in all respects only as illustrative of the present invention and not restrictive. Those skilled in the art to which the invention pertains may make various modifications and other embodiments employing the principles of this invention without departing from its spirit or essential characteristics particularly upon considering the foregoing teachings even when there are no explicit descriptions in this specification.

Other Applications

In the above-mentioned embodiment, a midsole structure for a running shoe was taken as an example, but application of the present invention is not limited thereto. The midsole structure according to the present invention also has application to other sports shoes such as walking shoes, training shoes, and the like.

INDUSTRIAL APPLICABILITY

As mentioned above, the present invention is of use to a midsole structure for a shoe, and it is especially suitable for a sports shoe that requires improved stability and cushioning property at the time of impacting the ground and also improved ride feeling during running.

DESCRIPTION OF REFERENCE NUMERALS

1: midsole structure
2: upper midsole (or midsole of a greater hardness)
2A: foot sole contact surface (or a top surface)
2B: boundary surface
3: lower midsole (or a midsole of a lower hardness)
3A: boundary surface.

The invention claimed is:

1. A sole structure for a heel region of a shoe, said sole structure comprising a midsole structure and an outsole that is disposed below said midsole structure and is adapted to contact a ground surface under the shoe, wherein said midsole structure comprises:

a harder upper midsole formed of a first elastic material extending from a lateral side edge through a widthwise central part to a medial side edge of said midsole structure at the heel region; and a softer lower midsole formed of a second elastic material that is softer than said first elastic material, wherein said softer lower midsole is disposed below at least a portion of said harder upper midsole and extends from said lateral side edge to at least said widthwise central part of said midsole structure at the heel region;

wherein on every cross-section extending widthwise through said midsole structure from said medial side edge through said widthwise central part to said lateral side edge at the heel region, said harder upper midsole is thicker than said softer lower midsole at least at said medial side edge of said midsole structure at the heel region, and said softer lower midsole is thicker than said harder upper midsole at said widthwise central part of said midsole structure at the heel region; and wherein a boundary between said harder upper midsole and said softer lower midsole does not appear on a top surface of said midsole structure at the heel region, and said top surface of said midsole structure at the heel region is formed entirely by a top surface of said harder upper midsole.

2. The sole structure according to claim 1, wherein said harder upper midsole and said softer lower midsole further extend to a tread region of the shoe, and wherein said harder upper midsole is thicker than said softer lower midsole on opposite sides of said midsole structure at the tread region, and said softer lower midsole, is thicker than said harder upper midsole at said widthwise central part of said midsole structure at the tread region.

3. The sole structure according to claim 2, wherein a boundary between said harder upper midsole and said softer lower midsole does not appear on said top surface of said midsole structure at the tread region.

4. The sole structure according to claim 2, wherein said harder upper midsole and said softer lower midsole extend farther forward beyond the tread region.

5. The sole structure according to claim 1, wherein said softer lower midsole is thicker than said harder upper midsole at a lateral rear end portion of said midsole structure at the heel region.

6. The sole structure according to claim 1, wherein said softer lower midsole extends below said harder upper midsole from said medial side edge to said lateral side edge of said midsole structure at the heel region, and said harder upper midsole is thicker than said softer lower midsole at both said medial side edge and said lateral side edge of said midsole structure at the heel region.

7. The sole structure according to claim 1, wherein said harder upper midsole is thicker than said softer lower midsole only at said medial side edge and not at said lateral side edge of said midsole structure at the heel region.

8. The sole structure according to claim 1, wherein said softer lower midsole is not disposed below an other portion of said harder upper midsole, and wherein said outsole further extends below said other portion of said harder upper midsole.

9. The sole structure according to claim 1, wherein a front end portion of said softer lower midsole tapers gradually thinner toward a front end of said softer lower midsole.

10. The sole structure according to claim 1, wherein only said harder upper midsole and not said softer lower midsole is disposed at least at a portion of an area at said medial side edge of said midsole structure at the heel region.

11. The sole structure according to claim 1, wherein said softer lower midsole is thicker than said harder upper midsole at an initial ground-contact area on a lateral side of said midsole structure at the heel region.

* * * * *